United States Patent [19]

Patrick

[11] Patent Number: 4,830,576

[45] Date of Patent: May 16, 1989

[54] METERING FUEL PUMP

[75] Inventor: Laughlin B. Patrick, Northridge, Calif.

[73] Assignee: Dukes, Inc., Northridge, Calif.

[21] Appl. No.: 117,970

[22] Filed: Nov. 9, 1987

[51] Int. Cl.[4] ..... F04B 25/00

[52] U.S. Cl. ..... 417/45; 417/251; 417/371; 418/9

[58] Field of Search ..... 418/9, 15; 417/253, 417/371, 291, 244, 45, 366, 251, 368

[56] References Cited

U.S. PATENT DOCUMENTS

| | | | |
|---|---|---|---|
| Re. 27,069 | 2/1971 | Roosa | 417/253 |
| 1,911,128 | 5/1933 | Apple | 417/371 |
| 2,825,286 | 3/1958 | White | 417/371 |
| 2,993,449 | 7/1961 | Harland | 417/371 X |
| 4,116,588 | 9/1978 | Phillips et al. | 418/9 |
| 4,204,810 | 5/1980 | Vogel | 417/244 |
| 4,205,947 | 6/1980 | Ruhl et al. | 417/251 X |
| 4,336,002 | 6/1982 | Rose et al. | 417/366 X |
| 4,519,755 | 5/1985 | Hanson | 418/9 |
| 4,606,707 | 8/1986 | Kumata | 417/410 X |
| 4,629,399 | 12/1986 | Friebe | 417/205 |
| 4,643,653 | 2/1987 | Masaka et al. | 417/417 |
| 4,726,746 | 2/1988 | Takada et al. | 417/366 X |

*Primary Examiner*—Leonard E. Smith
*Attorney, Agent, or Firm*—Elliott N. Kramsky

[57] ABSTRACT

A metering fuel pump adapted for feeding fuel containing vapor or air to an engine that includes a housing assembly. The metering fuel pump further includes a motor section encased inside the housing assembly for providing the required rotary motion to a two-stage pump section. The speed of the motor section is controlled by a motor controller section that provides a voltage regulated flow of fuel. The two-stage pump section imparts pressure to the fuel and encloses a cyclonic vapor separator section.

3 Claims, 3 Drawing Sheets

METERING FUEL PUMP

BACKGROUND

1. Field of the Invention

The present invention relates in general to a fuel pump, and it more particularly relates to a pump for supplying liquid fuel to an engine in response to an electronic control device.

2. Description of the Prior Art

Liquid fuel pumps of the general type with which the present invention is concerned have been utilized in various industries for feeding fuel under pressure to different types of engines. A conventional fuel pump generally includes a plurality of modules such as a vapor separator, an engine-driven fuel pump, a boost pump, a pressure regulator, and a fuel control. The multi-modular arrangement increases the cost of the pump and further renders it too bulky, heavy and inaccurate for use in particular specialized applications such as in the defense and military industries.

Moreover, the foregoing problems associated with the conventional fuel pumps are compounded by the use of fuel lines interconnecting the constituent modules. Such inter-modular interconnection intensifies the concerns related to the formation of fuel vapor. Thus, the fuel pump draws in not only fuel, but also unavoidable bubbles of vapor through a suction port, or, in an extreme state, sucks only the fuel vapor so that a fuel pressure is not performed in the fuel pump. As a result, a vapor lock or flame-out phenomenon occurs and the engine stops. The fuel vapor limits the ability to accurately control the engine speed, and, therefore, renders the use of the pump undesirable in certain applications where accuracy is a prime concern such as in airborne or missile applications.

A number of unsuccessful arrangements have addressed the existing problems in the field and have attempted to improve the accuracy of the conventional pumps. Exemplary attempted techniques are disclosed in the following U.S. Pat. Nos. 4,288,983 to O'Rourke, Jr., for "Turbofan Engine Having Core Supercharging Stage"; 4,293,273 to Romanov et al., for "Axial-Flow Reversible Turbine"; 4,390,316 to Alison for "Turbine Wheel"; 4,494,560 to Napolitano, et al., for "Self-Priming System for Liquid Pumps"; 4,538,958 to Takei, et al, for "Fuel Pump Having Regenerative Section Provided With Vent Housing For Voltene Flow"; 4,538,959 to Cantor, et al., for "Clean-In-Place Pump"; 4,538,960 to Iino, et al., for "Axial Thrust Balancing Device for Pumps"; 4,545,725 to Ikeda, et al., for "Stress Corrosion Cracking Proof Steam Turbine"; and 4,588,351 to Miller, et al., for "Centrifugal-Type Air Blower Bleed Off Arrangement".

It has been known to provide a regenerative pump with a vapor vent about midway of a pump passage in order to discharge the fuel vapor out of the fuel pump. The conventional vapor vent, however, only connects the pump passage with the outside of the pump, and hence it is inevitable that a substantial amount of fuel is discharged outside of the pump through the vapor vent, even when no fuel vapor is present.

SUMMARY OF THE INVENTION

Therefore, an object of the present invention is to provide a new and improved metering fuel pump capable of discharging the fuel vapor out of the pump.

Another object of the present invention is to provide a new and improved metering fuel pump which prevents the vapor-lock phenomenon.

A further object of the present invention is to provide such a new and improved metering fuel pump which is accurate, compact and light in weight.

Another object of the present invention is to provide such a new and improved metering fuel pump which has a low power consumption and which substantially reduces, if not totally eliminates undesirable flow variations due to the vapor content of the fuel.

Briefly, the above and further objects and features of the present invention are provided by a metering fuel pump adapted for feeding fuel containing vapor or air to an engine that includes a housing assembly. The metering fuel pump further includes a motor section encased inside the housing assembly for providing the required rotary motion to a two-stage pump section. The speed of the motor section is controlled by a motor controller section that provides a voltage regulated flow of fuel. The two-stage pump section imparts pressure to the fuel and encloses a cyclonic vapor separator section.

BRIEF DESCRIPTION OF THE DRAWINGS

The foregoing and other objects and features of this invention and the manner of attaining them will become apparent, and the invention itself will be best understood by reference to the following description of the embodiment of the invention in conjunction with the accompanying drawings, wherein.

DETAILED DESCRIPTION

Figure 1:
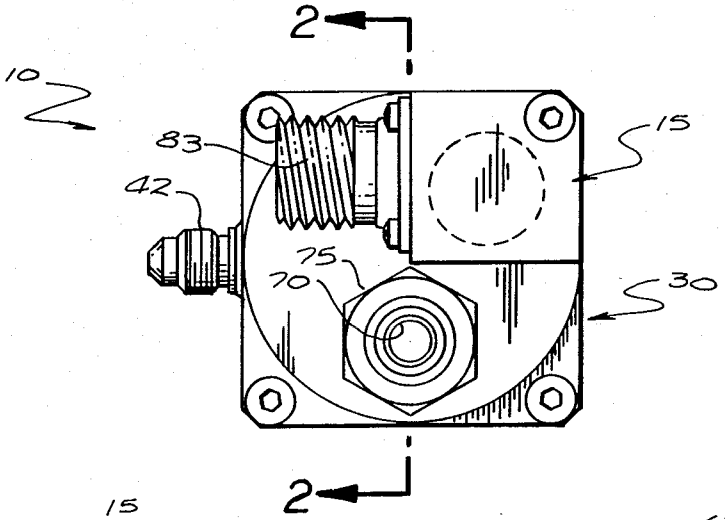
FIG. 1 is a side elevational view of a metering fuel pump which is constructed in accordance with the present invention.
Figure 2:
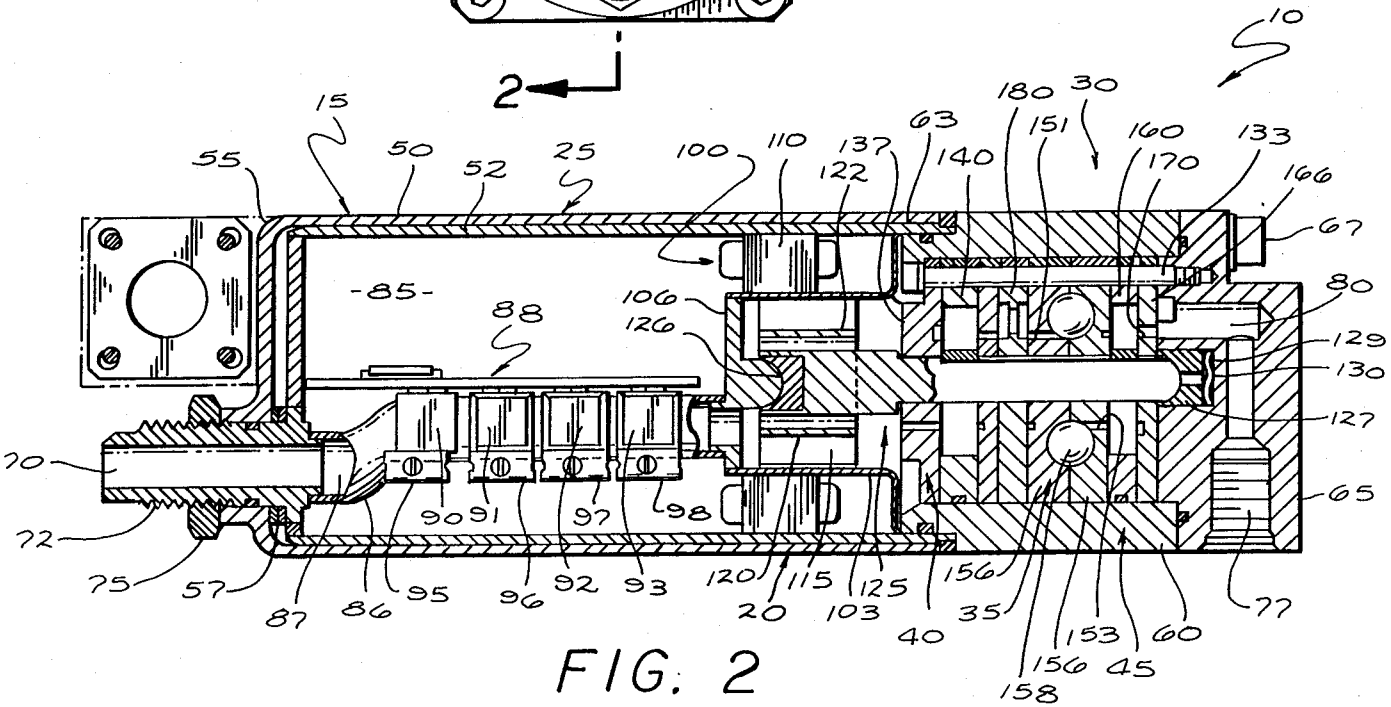
FIG. 2 is a cross-sectional front elevational view of the metering fuel pump of FIG. 1 taken on line 2—2 thereof.

Referring now to the drawings, and more particularly to FIGS. 1 and 2 thereof, there is illustrated a metering fuel pump 10 which is constructed in accordance with the present invention and which is adapted for feeding liquid fuel to an engine.

The pump 10 generally includes a housing assembly 15 that encases a motor section 20 for providing the required rotary motion and for receiving the fuel. A motor controller section 25 controls the speed of the motor section 20 and regulates the flow of fuel through the pump 10. A two-stage pump section 30 accelerates the flow of fuel and imparts pressure thereto. It further achieves the required "delivery head" and causes the fuel to be delivered at a substantially steady flow. A separator section 35 causes the fuel and the vapor (air) contained therein to be separated and to be routed independently.

In operation, the fuel is admitted to the pump 10 through the motor section 20 at a rate which is determined and controlled by the motor controller section 25. The fuel is then drawn into a first or primary stage 40 of the pump section 30 where it is accelerated.

The accelerated fuel is subsequently passed through a separator section 35 where the vapor is caused to be separated from the fuel and to be expelled from the pump 10 through a vapor return outlet 42. The separated or devaporized fuel is then drawn into a second or metering stage 45 prior to its being channelled to the engine.

Considering now the housing assembly 15 in greater detail with particular reference to FIGS. 1 and 2, it is self-contained, tubular and elongated in construction. The housing assembly 15 generally includes an outer casing 50 and an inner casing 52 that are interconnected by conventional known techniques. The inner and outer casings 50 and 52 are spaced apart at one axial end 55 of the pump 20 by one or more spacers, such as the spacer 57.

The housing assembly 15 further includes a block 60 that is connected to the opposite axial end 63 defined by the inner and outer casings 50 and 52. The block 60 is partially closed at its other end by an end cap 65, and it is retained thereto by a screw 67.

Considering now the inlets and outlets defined by the housing 15, they generally comprise an elongated tubular inlet port 70 that is hollow throughout its axial length for receiving the fuel. The inlet port 70 includes external threads 72 for threadably engaging a nut 75, in order to be secured thereby, to the outer casing 50. While the inlet port 70 illustrated in FIG. 2 includes a male connector, it will become apparent to those skilled in the art that a female connector can be substituted therefor.

An elongated tubular outlet port 77 is hollow throughout its axial length for permitting the passage of the devaporized fuel, and it is substantially fully encased inside the end cap 65. The outlet port 77 is maintained in fluid communication with the metering stage 45 via an elongated passageway 80. While the outlet port 77 illustrated in FIG. 2 includes a female connector, it will become apparent to those skilled in the art that a male connector can be substituted therefor.

The vapor return outlet 42 includes a hollow tubular member that protrudes outwardly from the housing block 60 and communicates with the separator section 35 via an opening (not shown). A threaded connector 82 is secured to the bossing 15 for providing an access to the electronic components of the motor controller section 25.

Turning now to the motor controller section 25, it will be described in greater detail with reference to FIGS. 2 and 4 of the drawings. The motor controller section 25 is disposed intermediate the end 5 and the motor section 20 and defines an elongated chamber 85 for receiving a filter or other such accessories (not shown).

A conduit 86 formed of metallic or other material of suitable heat conductivity is disposed axially inside the chamber 85 and interconnects the inlet port 70 and the motor section 20 in fluid communication. The conduit 86 is tubular and hollow throughout its entire axial length for defining an open path or passage 87 for the fuel.

Figure 4:
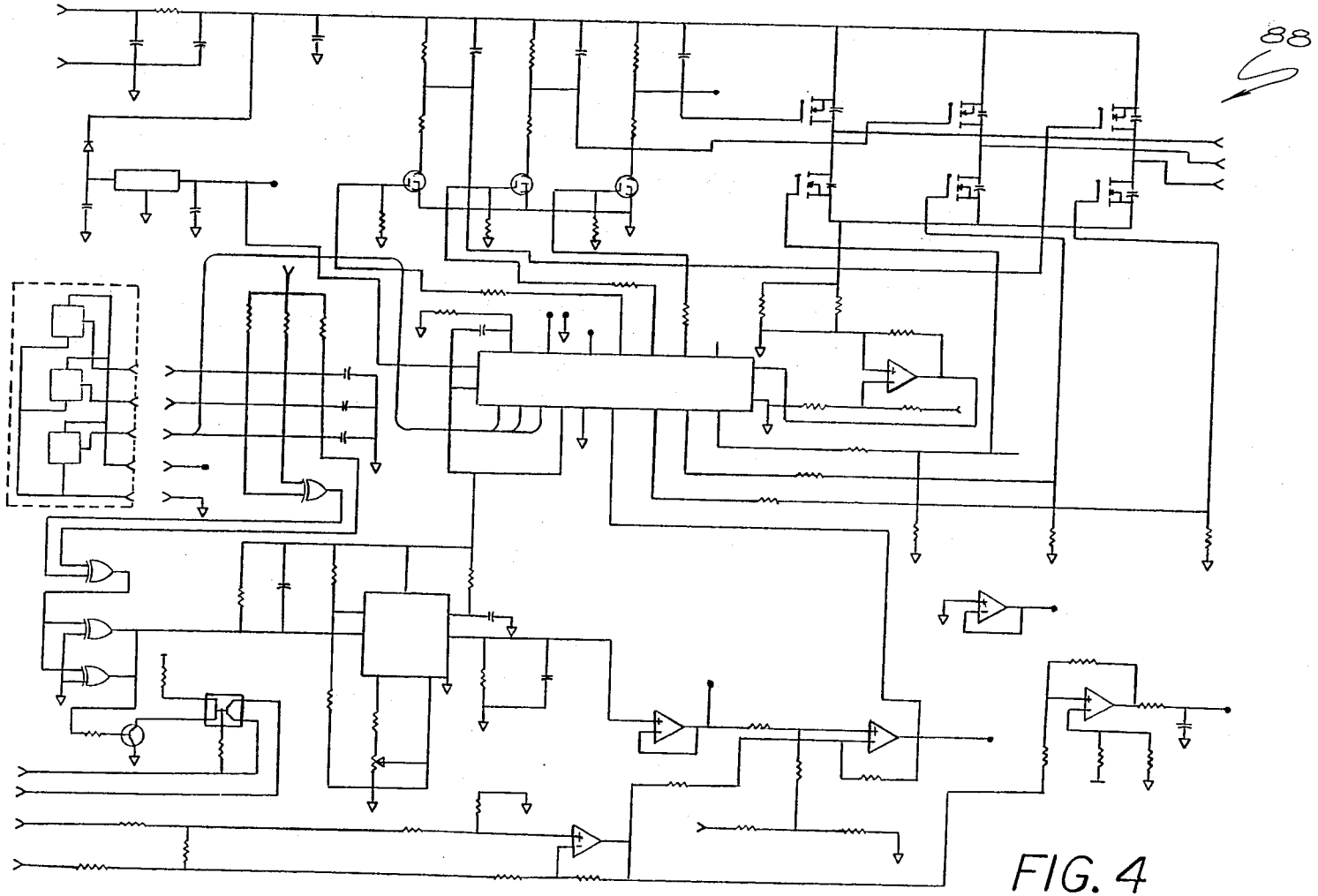
FIG. 4 is a circuit diagram of the electronic control circuitry that forms a part of the metering fuel pump of FIG. 1.

A printed circuit board 88 includes electronic components comprising an arrangement illustrated schematically in FIG. 4 for controlling the flow of fuel through the pump 10. The printed circuit board 88 is foldable into a substantially flat structure for protecting and sealing it form the surrounding fluid environment. The printed circuit board 88 is disposed inside the chamber 85 and secured to the conduit 86 in a suitable position.

A plurality of power transistor modules such as the transistors 90, 91, 92 and 93 are secured to the conduit 86 by suitable conventional techniques such as by the clamps 95, 96, 97 and 98. The power transistors 90, 91, 92 and 93 and the other associated electronics are effectively cooled by the relatively cool incoming flow of fuel within the conduit 86 and along the fuel path 87. By utilizing the input fuel flow to cool the electronics, an otherwise impossible degree of compactness of the design is attained in regard to the system's control electronics.

Considering now the motor section 20 in greater detail with respect to FIG. 2, it generally includes a brushless variable speed electrical motor 100 that is attached to the internal surface of the inner casing 52 and to the conduit 86 by a tubular plate 103 and a guide bearing 106. The motor 100 includes a stator and associated winding 110 and a plurality of rotary magnets 115, such as an eight-pole magnet. The magnets 115 define a plurality of corresponding axial bores, such as the bores 120 and 122 for defining a fuel path through the motor section 20.

The use of the brushless motor 100, as opposed to the conventional brush type motor, presents several advantages. The brushless motor 100 renders the overall operation of the pump 10 more efficient and reliable. Unlike the brush-type motors, the motor 100 is not susceptible to arcing due to the reduced pressure. Furthermore, the brush-type motors offer an inferior seal relative to brushless type motors, and they do not enjoy an extended storage life. In fact, the contact points of the brush-type motors corrode readily within about five years.

A rotary shaft assembly 125 extends coaxially with the housing assembly 15 and extends through the pump section 30. It is rotatably supported at its axial ends by two bearings 126 and 127. The bearing 126 is rotatably secured to the bearing 106, while the bearing 127 fits inside a complementary shaped chamber 129 defined by the end cap 65. The bearing 127 engages a wave spring 130 that is disposed inside the chamber 129 for absorbing the shocks and for retaining the shaft assembly 125 securely in position without causing undue vibrations.

As illustrated in FIG. 2, the separator section 35 is retained inside the pump section 30 between the primary stage 40 and the metering stage 45. A plurality of axial pins, such as the pins 133 and 135, are disposed intermediate the housing block 60 and the separator section 35 for limiting the rotation of the latter section. Therefore, only one motor 100 is required to drive the two-stage pump section 30, thus contributing to the reduction of the overall size of the pump 10.

The primary stage 40 of the pump section 30 includes a stationary primary cavity or block 137 having a kidney-shaped inlet. The primary block 137 is composed of a suitable high temperature self-lubricating thermoplastic material such as the one manufactured by Phillips Petroleum and sold under the trademark "RYTON". The particular materials employed within this invention may vary. Those parts that must contact the fuel must, of course, be resistant to recognized corrosive effects. Thus, for example, RYTRON is an appropriate elastomeric material for use in an environment of JP-10 missile fuel. The various parts described herein which must contact the fuel may be alternatively composed of, among others, the product marketed under the trademark "VESPEL" of DuPont and hard anodized aluminum. The primary stag 40 further includes a conventional gear type pump generally known as a gerotor 140 that is driven by the shaft assembly 125 and connected in fluid communication with the primary cavity 137.

Figure 3:
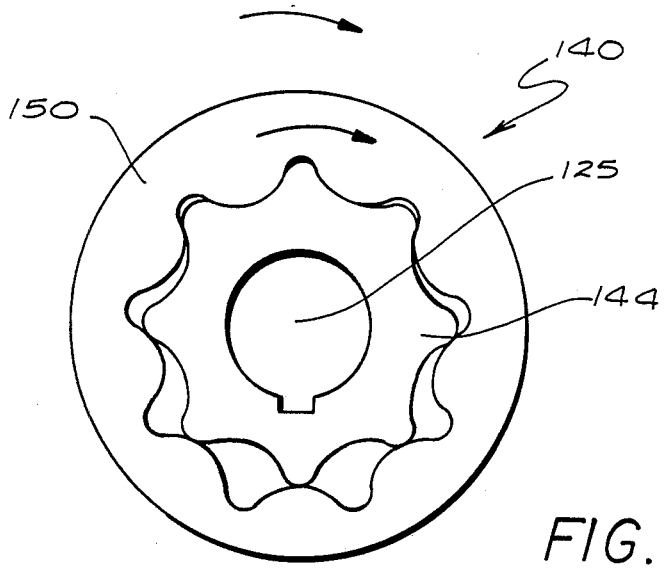
FIG. 3 is a cross-sectional schematic view of a gerotor that forms a part of the metering fuel pump of FIG. 1.

As illustrated in FIG. 3, the gerotor 140 includes an internal gear or drive mechanism 144 and an external gear or driven mechanism 150. The principle upon which this type of pump operates is that the gear mechanisms 144 and 150 are driven by an external means such as the motor 100, and the pumped fluid such as fuel infiltrates into the pump as a partial vacuum is formed, and it is then discharged by the imperfect meshing of the gear teeth. The gerotor type pumps are generally affordable, have few moving parts, and feature simplicity in design and construction.

Thus, the fuel flows axially from the primary cavity 137 toward the primary gerotor 140, is deflected and accelerated by it, and flows out through the apertures between the internal and external gear mechanisms 144 and 150. This produces an increase in pressure at the outlets of the gerotors. On leaving the gerotor 140, the fuel passes through a flow alignment plate 180, then to an opening 151 to the separator section 35, whereupon the vapor is separated from the fuel.

The separator section 35 generally includes a conventional cyclonic vapor fuel separator that causes the counterflow of the vapor and the fuel. Thus, while the separated vapor (air) flows in one direction and is expelled through the return outlet 42, the devaporized fuel flows in the opposite direction and is communicated to the metering stage 45 prior to completing a full cycle. In general, it has been found that an exit or discharge passage 153 that is oppositely disposed relative to the entrance opening 151 produces the desired separation of vapor.

For this purpose, the separator section 35 includes two substantially identical annular blocks 155 and 156 defining a central annular bore 158 that is circular in cross-section. The blocks 155 and 156 are composed of suitable high temperature self-lubricating material such as RYTON. As mentioned above, the fuel passes through a flow alignment plate 180 prior to entering the vapor fuel separator. The plate 180, preferably formed of aluminum, serves to align the flow so that the circulation of the fuel within the separator attains greater efficiency. As a result, it has been found that an increase of up to fifteen (15) percent in the amount of air removed from the output can be achieved.

The metering stage or section 45 is substantially similar to the primary stage or section 40, with the exception that the thickness of the pump or gerotor 160 is selectively varied to regulate the flow of fuel. The primary pump or gerotor 140 draws in a larger volume of fuel (overcapacity) than does the metering gerotor 160 due to the volume of the separated vapor. Thus, the relative thickness of the gerotor 140 and 160 determines the volume of vapor to be separated (overcapacity factor).

The gerotors 140 and 150 can be made of milled steel, or, in the alternative, they could be composed of suitable thermoplastic material. The metering stage 45 further includes a metering cavity or block 166 that is generally similar in composition to the primary cavity 137 and that includes a passageway 170 for defining a fuel path and for connecting the gerotor 160 and the outlet port 77 in fluid communication with one another.

Figure 5:
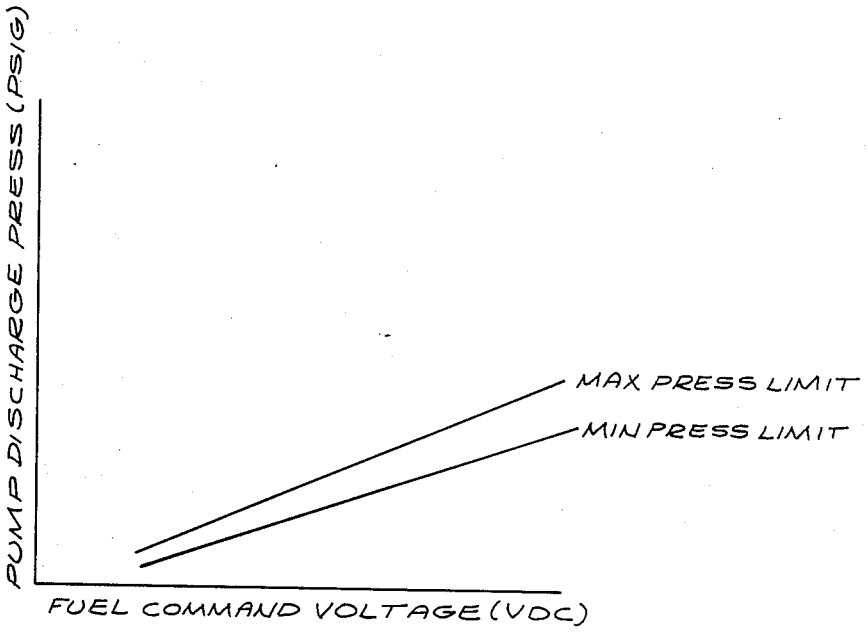
FIG. 5 is a graphical representation of the discharge pressure relative to the fuel command voltage in the pump of FIG. 1.

Thus, as illustrated in FIG. 5, the output pump discharge pressure is accurately and substantially linearly controlled by the voltage applied to the variable speed motor 100. Hence, since the voltage applied to the motor 100 can be controlled digitally with substantial accuracy, the speed of the motor 100 can be similarly controlled accurately. Furthermore, since each revolution of the motor 100 admits a constant amount of fuel therein, the fuel flow is selectively accurately controlled. Therefore, the speed of the motor 100 is the controlling factor, and by changing such speed, one can control the speed of the metering stage 45, which results in a precise fuel metering.

The present two-stage metering pump 10 functionally substitutes the conventional fuel pump and carburetor and is substantially compact in size and light in weight. In fact, the overall length of the pump 10 is about 6 inches and its weight is about 2.5 to 3 pounds, while a conventional pump weighs about 5 pounds.

While the present invention has been illustrated and discussed with regard to its presently preferred embodiment, its scope is not limited thereto. Rather, it is limited only insofar as defined in the following set of claims and equivalents thereof.

What is claimed is:

1. A compact unit for delivering fuel to an engine at a predetermined flow rate and pressure comprising, in combination:

(a) an inlet port at a first end of a substantially tubular housing for accepting input fuel;

(b) a voltage controlled d.c. brushless motor, the predetermined speed of said motor being regulated to maintain said predetermined value;

(c) a motor control comprising a feedback circuit located in an elongated chamber within said housing for providing a driving voltage to said motor whereby said motor is caused to operate at said predetermined speed;

(d) a shaft engaged to said motor for accepting the output of said motor;

(e) a two stage pump in communication with said shaft and responsive to the speed of said motor whereby the rate of flow of fuel therethrough is a function of the speed of said motor;

(f) said two stage pump including a first gerotor engaged to said shaft and located between stationary inlet and outlet plates of a primary section and a second gerotor engaged to said shaft and located between stationary inlet and outlet plates of a metering section;

(g) an outlet port adjacent the opposite end of said substantially tubular housing for accepting the output of said two stage pump;

(h) a cyclonic fuel separator located between said gerotors, said fuel separator, said two-stage pump and said motor being coaxially aligned within said tubular housing;

(i) said fuel separator including (i) an adjacent pair of plates, each including a hemispherical surface channel, said plates being arranged to form a circular bore therebetween, (ii) a fuel inlet passage within one of said plates and a fuel outlet passage within the other of said plates, said plate including a fuel outlet passage being the inlet plate of said metering section of said pump, and (iii) said inlet passage and said outlet passage are oppositely disposed with respect to said circular bore; and (j) each of the elements of said unit is contained within said substantially tubular housing.

2. A unit as defined in claim 1 further including a flow alignment plate adjacent a block of said vapor fuel separator and including an aperture in alignment with said fuel inlet passage.

3. A unit as defined in claim 2 enclosed within said substantially tubular housing.

* * * * *